US006830135B2

(12) United States Patent
Lin et al.

(10) Patent No.: US 6,830,135 B2
(45) Date of Patent: Dec. 14, 2004

(54) HANDLE ASSEMBLY HAVING A SINGLE HANDLE ROD OF WHEELED LUGGAGE

(75) Inventors: Jer Hong Lin, Taipei (TW); Shih Yu Chang, Taipei (TW); Chung-Hsien Kuo, Pan-Chiao (TW); Chia Hsien Lin, Taipei (TW)

(73) Assignee: Chaw Khong Technology Co., Ltd., Taipei County (TW)

( * ) Notice: Subject to any disclaimer, the term of this patent is extended or adjusted under 35 U.S.C. 154(b) by 0 days.

(21) Appl. No.: 10/280,005

(22) Filed: Oct. 25, 2002

(65) Prior Publication Data

US 2003/0079950 A1 May 1, 2003

(30) Foreign Application Priority Data

Oct. 26, 2001 (CN) ..... 01267237 U
Oct. 26, 2001 (CN) ..... 01267238 U

(51) Int. Cl.[7] ..... A45C 13/00; A45C 13/30

(52) U.S. Cl. ..... 190/115; 190/18 A; 190/39; 16/113.1

(58) Field of Search ..... 190/18 A, 39, 190/115; 16/113.1, 114.1

(56) References Cited

U.S. PATENT DOCUMENTS 5,464,080 A * 11/1995 Liang ..... 190/18 A
6,317,924 B1 * 11/2001 Gallagher ..... 16/114.1
6,508,344 B1 * 1/2003 Lu ..... 190/115
6,530,459 B1 * 3/2003 Lu ..... 190/115
6,591,951 B1 * 7/2003 Chen ..... 190/115
6,651,791 B1 * 11/2003 Nykoluk et al. ..... 190/18 A
2003/0132079 A1 * 7/2003 Bellini

FOREIGN PATENT DOCUMENTS

DE 3636064 A1 * 4/1988 ..... A45C/5/14

* cited by examiner

*Primary Examiner*—Sue A. Weaver
(74) *Attorney, Agent, or Firm*—Troxell Law Office, PLLC

(57) ABSTRACT

A handle assembly having a single handle rod of wheeled luggage is provided. The handle grip is extended toward and proximate either side of luggage for ease of holding. Also, there is no interference of user's body with wheel while towing luggage. Moreover, the handle grip is capable of being disposed either parallel or perpendicular with respect to a straight line between wheels of the luggage by rotating either clockwise or counterclockwise for ease of being gripped by either hand which tows the luggage.

15 Claims, 13 Drawing Sheets

HANDLE ASSEMBLY HAVING A SINGLE HANDLE ROD OF WHEELED LUGGAGE

BACKGROUND OF THE INVENTION

1. Field of the Invention

The present invention relates to wheeled luggage and more particularly to an improved handle assembly having a single handle rod of wheeled luggage.

2. Description of Related Art

Conventionally, a handle assembly of wheeled luggage has a pair of handle rods. This has the advantage of increased stability while towing luggage. However, it also consumes some precious storage space of luggage because a portion of rear is configured to receive the handle assembly. Further, more components means higher possibility of fail of luggage and higher manufacturing cost. Hence, a handle assembly having a single handle rod has been developed. Such is best illustrated in FIGS. 16 and 17. For increasing the structural strength, a handle rod H has a larger diameter. The prior art is unsatisfactory for the purpose for which the invention is concerned for the following reasons: User may feel uncomfortable by holding both a T-shaped handle grip G and a joint C between the handle grip G and a handle rod H. Also, a trouser T may interfere with one wheel while towing luggage because the handle grip G does not extend laterally enough (i.e., it is near the center of luggage). It is quite inconvenient.

Thus, it is desirable to provide a handle assembly having an improved single handle rod of wheeled luggage in order to overcome the above drawbacks of prior art.

SUMMARY OF THE INVENTION

It is an object of the present invention to provide a handle assembly having a single handle rod of wheeled luggage wherein the handle grip is extended toward and near one side of luggage for ease of holding. Also, there is no interference of user's body with wheel while towing luggage.

It is another object of the present invention to provide a handle assembly having a single handle rod of wheeled luggage wherein the handle grip is rotatable either clockwise or counterclockwise to an angle of about 180 degrees with respect to a straight line between wheels of the luggage so as to be gripped by either the right or the left hand which tows the luggage.

In one aspect of the present invention, there is provided a handle assembly of wheeled luggage comprising a handle grip extended toward and proximate either side of the luggage for eliminating an interference of a user with one of more wheels of the luggage, the handle grip including a pivot section having a first tunnel, a second tunnel within the first tunnel and having a longitudinal slit on each side surface, an upper section, a lower section, and a peripheral groove between the upper and the lower sections; a sleeve including an upper larger section having a plurality of holes on its periphery, a plurality of pegs inserted through the holes to slidingly contact the groove, a lower smaller section, and a bore through the lower smaller section; a push button assembly received in both the pivot section and the sleeve and including a push button on a top, a post extended downwardly from the push button and having a longitudinal rib on each side surface of the post being slidingly received in the slit, a lower cylindrical member having a diameter smaller than a width of the post, and a base, a recess on a bottom of the base, and an aperture inside the cylindrical member being open to the recess; a handle rod releasably secured to the sleeve; a seat releasably secured within the handle rod and including a circular flange on a top and a channel; and a spring having a top end anchored in the recess and a lower end put on the flange. In an operation the push button is operative to press to compress the spring and lower the base for disengaging from the bore, thereby enabling a rotation of the handle grip and a retraction of the handle rod.

In another aspect of the present invention, there is provided a handle assembly of wheeled luggage comprising a handle grip extended toward and proximate either side of the luggage for eliminating an interference of a user with one of more wheels of the luggage, the handle grip including a hollow bar having a space, a pivot section, a wedge having a first slanted surface, and a sliding member in the space and having a push button at one side on an opening of the hollow bar, a second slanted surface at the other opposite side engaged with the first slanted surface, and a pivot section including a tunnel having a longitudinal slit on each side surface, an upper section, a lower section, and a peripheral groove between the upper and the lower sections; a sleeve including an upper larger section having a plurality of holes on its periphery, a plurality of pegs inserted through the holes to slidingly contact the groove, a lower smaller section, and a bore through the lower smaller section; a push button assembly received in both the pivot section and the sleeve and including a push button on a top, a post on a bottom of the wedge and having a longitudinal rib on each side surface of the post being slidingly received in the slit, a lower cylindrical member having a diameter smaller than a width of the post, and a base, a recess on a bottom of the base, and an aperture inside the cylindrical member being open to the recess; a handle rod releasably secured to the sleeve; a seat releasably secured within the handle rod and including a circular flange on a top and a channel; and a spring having a top end anchored in the recess and a lower end put on the flange. In an operation the push button is operative to press push the sliding member inwardly, move the second slanted surface inwardly to press down the first slanted surface, compress the spring, and lower the base for disengaging from the bore, thereby enabling a rotation of the handle grip and a retraction of the handle rod.

The above and other objects, features and advantages of the present invention will become apparent from the following detailed description taken with the accompanying drawings.

DETAILED DESCRIPTION OF THE PREFERRED EMBODIMENTS

Figure 2:
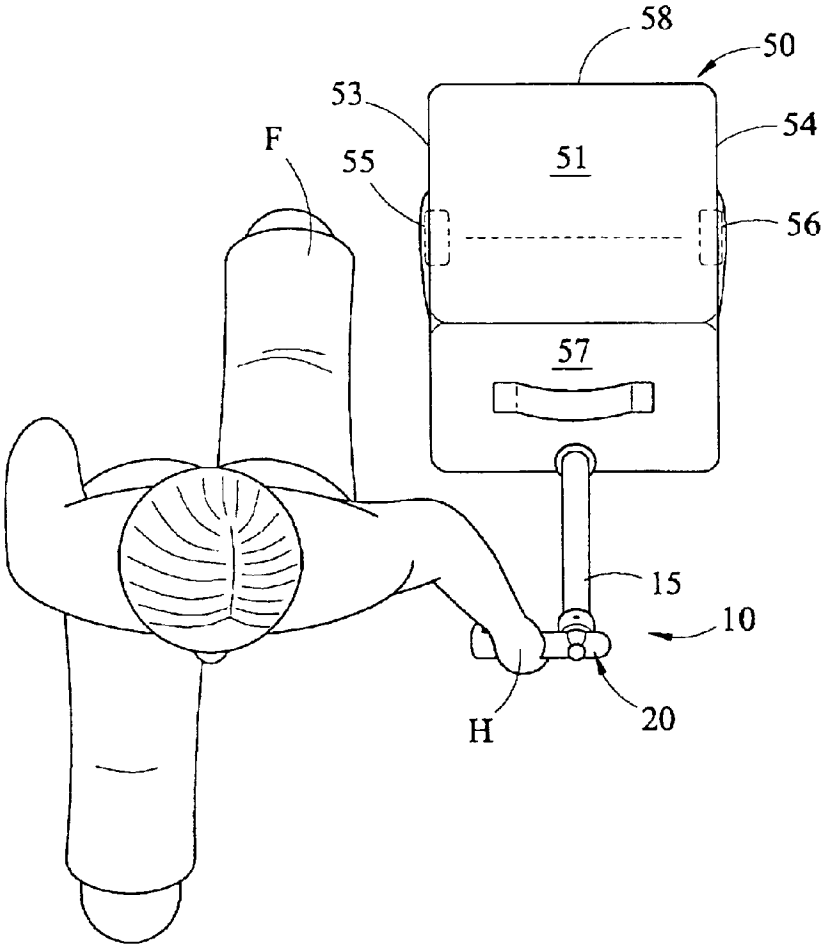
FIG. 2 is a top plan view showing the FIG. 1 luggage being towed.
Figure 1:
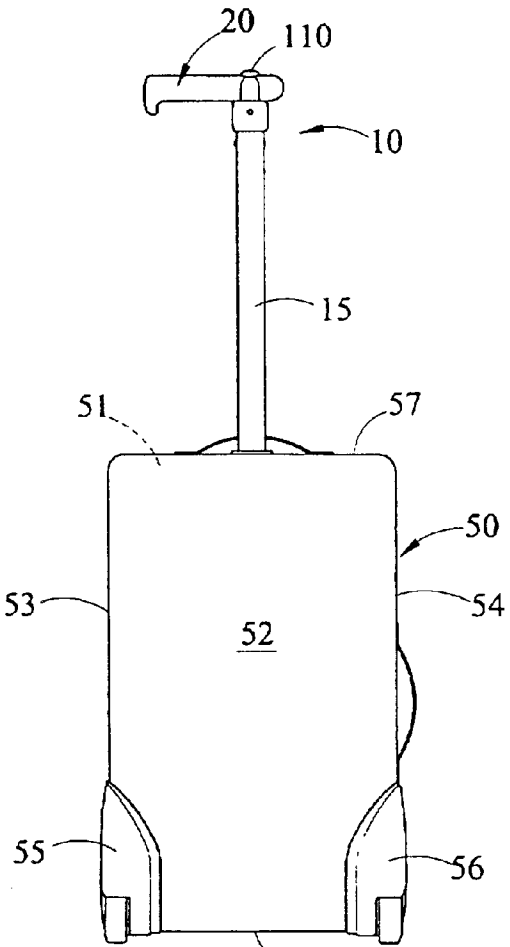
FIG. 1 is a rear plan view of a first preferred embodiment of handle assembly having a single handle rod according to the invention.
Figure 3:
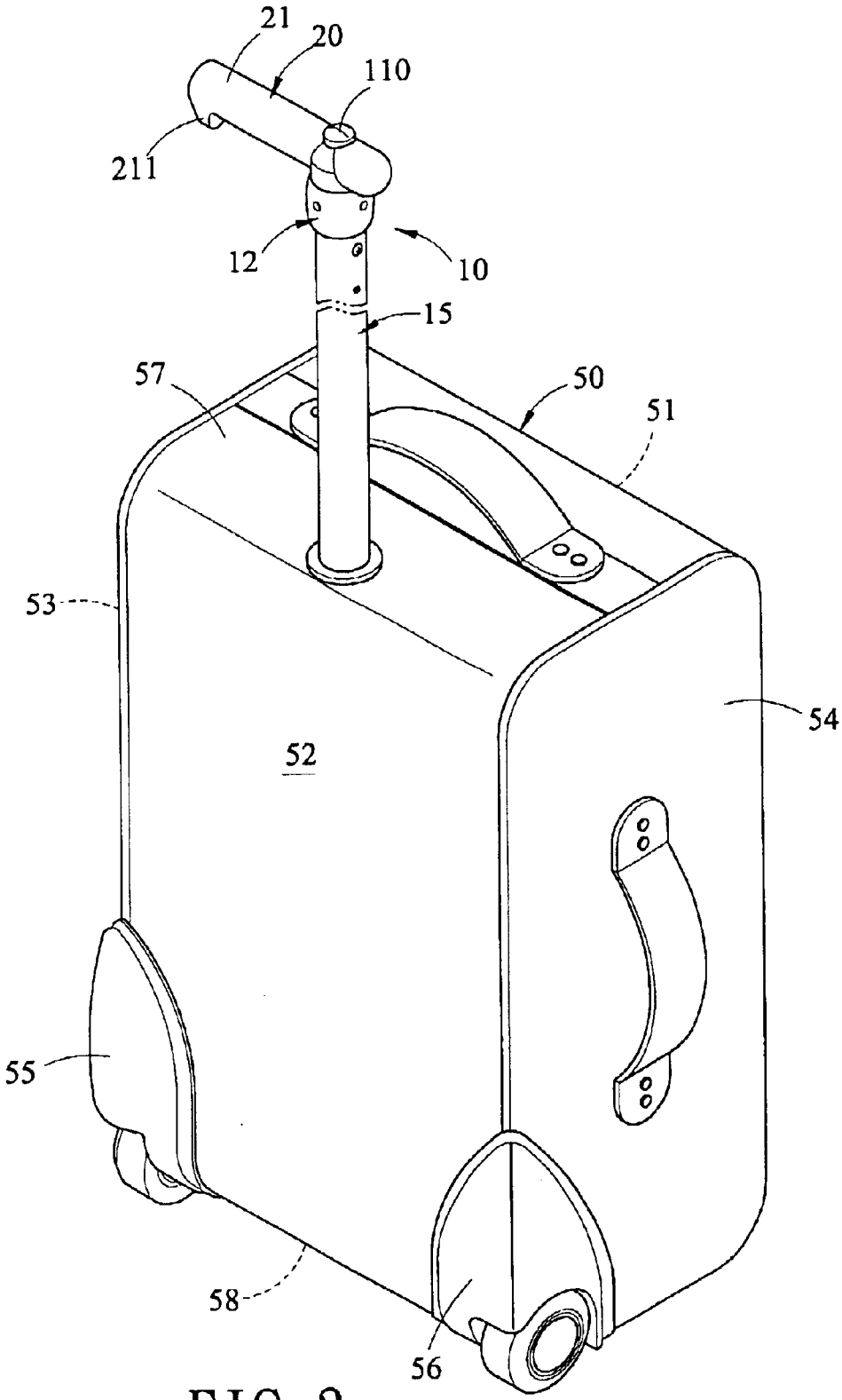
FIG. 3 is a perspective view of a second preferred embodiment of handle assembly having a single handle rod according to the invention.

Referring to FIGS. 1 and 2, there is shown a first preferred embodiment of luggage 50 according to the invention comprising a front 51, a rear 52, two sides 53 and 54, a top 57, a bottom 58, two wheels 55 and 56, and a retractable handle assembly 10 which is the subject of the invention. The handle assembly 10 comprises a handle rod 15 (i.e., first sliding tube) having an upper portion and a lower portion, a handle grip 20 extended horizontally from a top of the handle rod 15 (i.e., parallel to a straight line between wheels, the top 57, or the bottom 58) in a normal unused position wherein the horizontal extension length of the handle grip 20 is slightly smaller than a half of width of the top 57.

It means that the handle grip 20 is extending horizontally from the top of the handle rod 15 almost to a side 53 of the luggage. As shown in FIG. 2, in a case that the left hand holds the handle grip 20 a sufficient distance between the side 53 and the foot F is obtained. As a result, the user's foot is prevented from being interfered with the wheel 55 while towing the luggage 50. It is noted that the handle grip 20 may be extended toward and sufficiently proximate the right side 54 for being adapted to be gripped by the user's right hand in the other embodiment without departing from the scope and spirit of the invention.

Referring to FIGS. 3 to 8, there is shown a second preferred embodiment of luggage 50 constricted in accordance with the invention comprising a front 51, a rear 52, two sides 53 and 54, a top 57, a bottom 58, two wheels 55 and 56, and a retractable handle assembly 10 extended upward from a center at a joining edge of the top 57 and the rear 52. The handle assembly 10 is the subject of the invention and will be described in detail as follows. The handle assembly 10 comprises a handle grip 20, a sleeve 12, a push button assembly 11, a first sliding tube 15, a second sliding tube 16, a support tube 17, a first locking device 18, and a second locking device 19. Note that the components and operation of the handle assembly 10 are well known. Thus a detailed description thereof is omitted herein for the sake of brevity except those detailed below.

Figure 4:
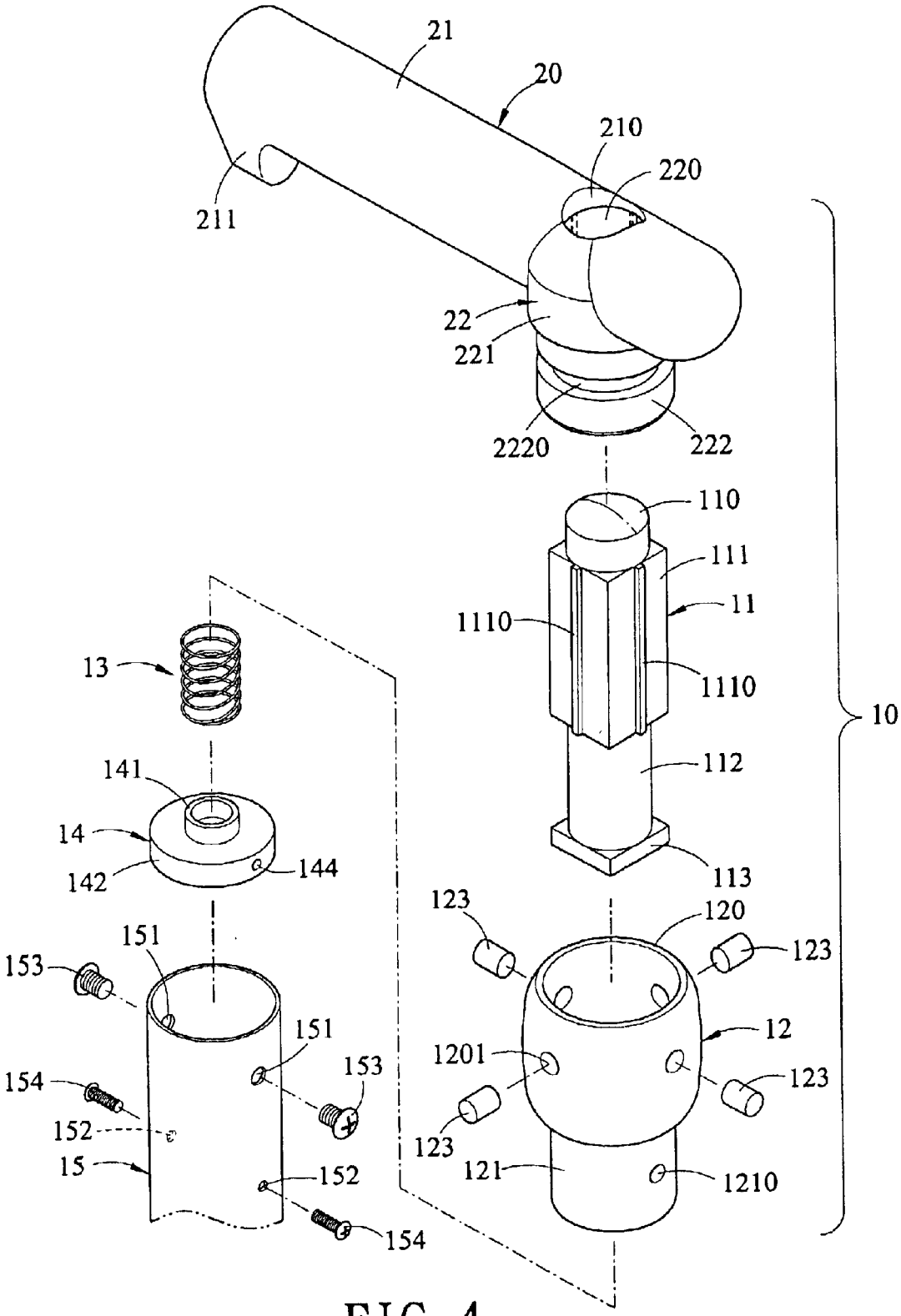
FIG. 4 is an exploded perspective view of FIG. 3 handle assembly.
Figure 5:
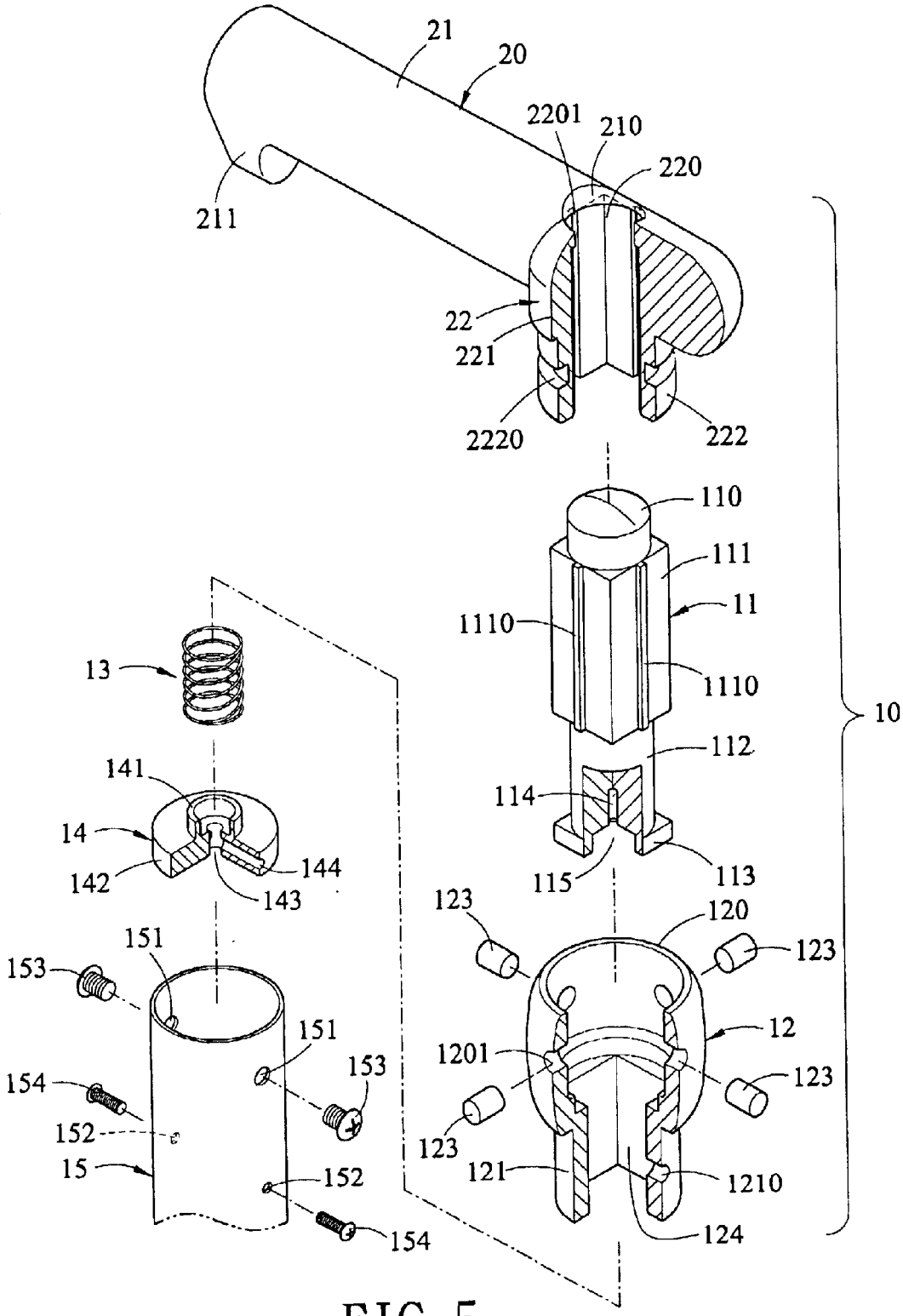
FIG. 5 is a partial cross-sectional view of FIG. 4.

As shown in FIGS. 4 and 5, the handle grip 20 comprises a horizontal bar 21 having a downwardly extended hook 211 at one end, a pivot section 22 proximate the other end of the bar 21 having a circular tunnel 210 through the pivot section 22, a square tunnel 220 within the circular tunnel 210 and having a longitudinal slit 2201 on each side surface, a large diameter section 221 on upper part of the pivot section 22, a small diameter section 222 below the large diameter section 221, and a peripheral groove 2220 between the large diameter section 221 and the small diameter section 222. The push button assembly 11 is received in both the pivot section 22 and the sleeve 12 and comprises a push button 110 on a top, a post 111 extended downwardly from the push button 110 and having a square cross-section and a longitudinal rib 1110 on each side surface of the post 111 being slidingly received in the slit 2201, a cylindrical member 112 having a diameter smaller than the width of the post 111 being extended downwardly from the post 111, and a square base 113, a recess 115 on a bottom of the base 113, and a central circular aperture 114 inside the cylindrical member 112 being open to the recess 115. The sleeve 12 comprises an upper larger section 120 having four equally spaced apart holes 1201 on its periphery, four pegs 123 inserted through holes 1201 to slidingly contact the groove 2220, a lower smaller section 121 having two opposite holes 1210 on its periphery, and a square bore 124 through the lower smaller section 121. The handle assembly 10 further comprises a seat 14 including a circular flange 141 on a top, a base 142, a tunnel 143 through the base 142, and two opposite holes 144 on its periphery open to the tunnel 143; and a spring 13 having a top end anchored in the recess 115 and a lower end put on the flange 141. The first sliding tube 15 comprises two upper opposite large holes 151, two screws 153 driven through holes 151 and holes 1210 to secure the first sliding tube 15 to the sleeve 12, two lower opposite small holes 152, two screws 154 driven through the holes 152 and 144 to secure the seat 14 within the first sliding tube 15.

Figure 6:
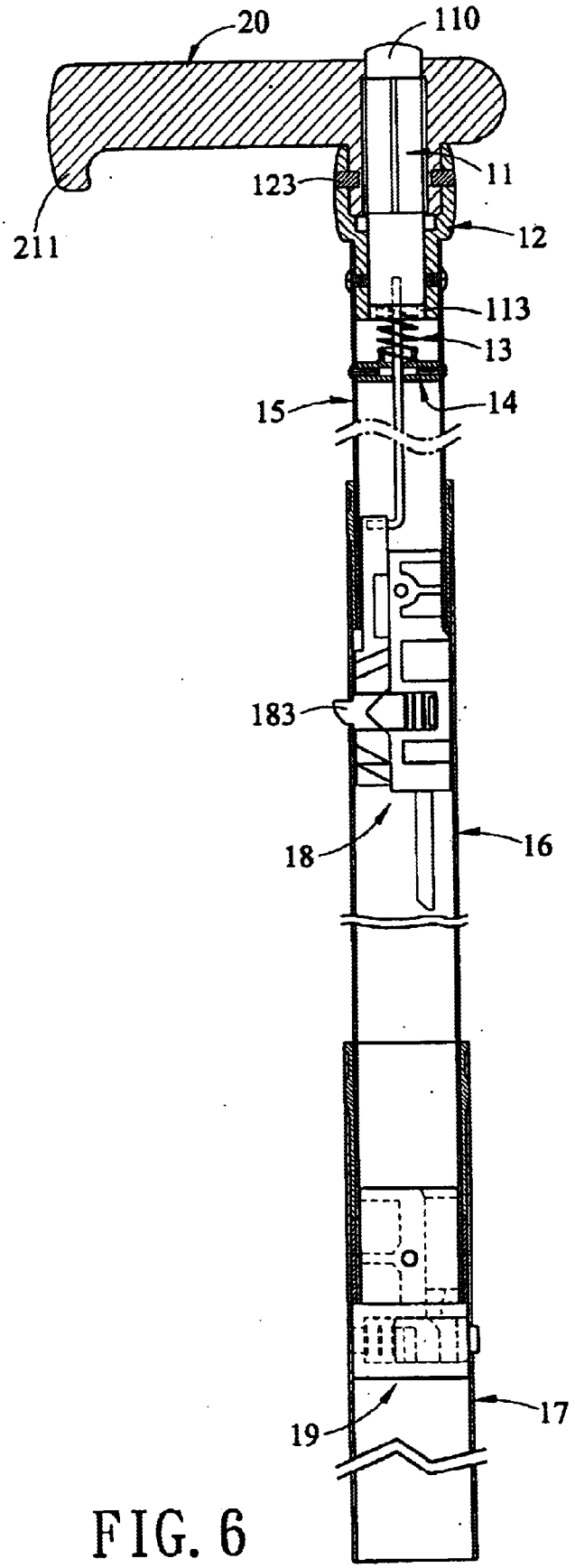
FIG. 6 is a cross-sectional view of FIG. 3 handle assembly in a locked position.

The assembled handle assembly 10 is shown in FIG. 6 wherein the base 113 is urged upwardly by the spring 13 to be stopped at the top edge of the bore 124 and a spring depressible locking pin 183 is inserted into one of a plurality of apertures on the second sliding tube 16 in a locked state.

Note that one characteristics of the invention is that there is no interference of user's foot F with the wheel 55 while towing the luggage 50. This is because the handle grip 20 is extended toward and sufficiently proximate one side (e.g., the left side 53 as shown in FIG. 2) of the luggage for being adapted to be gripped by the user's left hand, thus leaving a sufficient distance between the user's foot F and the wheel 55. It is further noted that the handle grip 20 may be extended toward and sufficiently proximate the right side 54 for being adapted to be gripped by the user's right hand in the other embodiment without departing from the scope and spirit of the invention.

Figure 7:
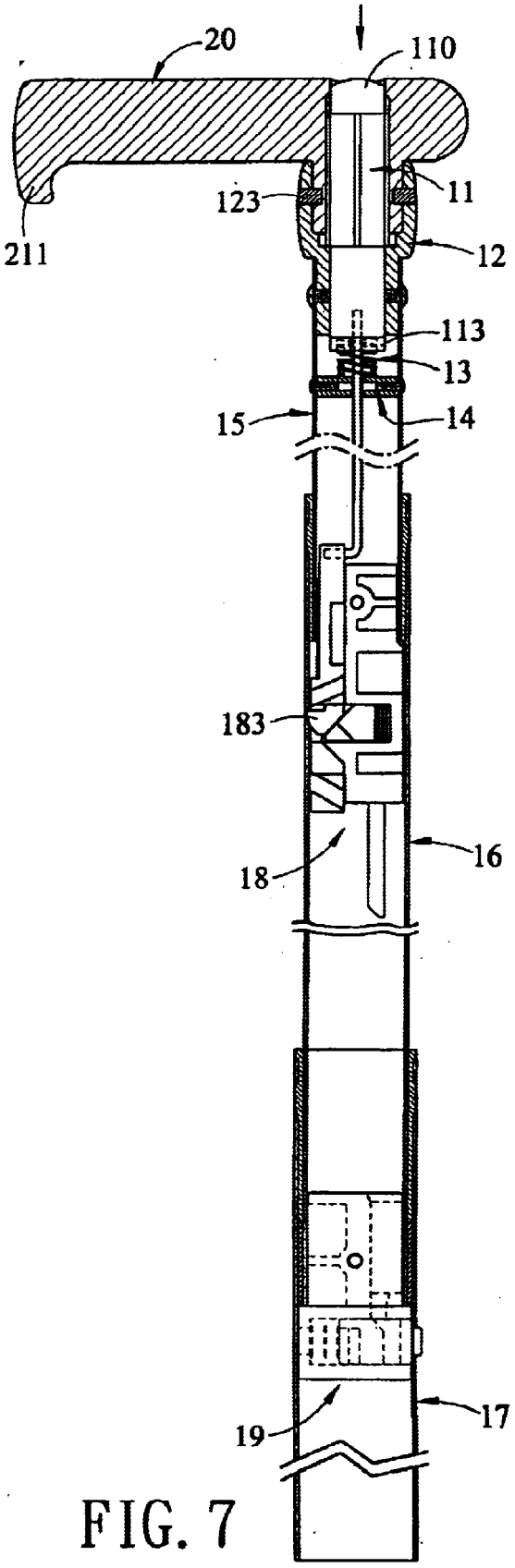
FIG. 7 is a view similar to FIG. 6 where push button is pressed and handle assembly is in an unlocked position.
Figure 8:
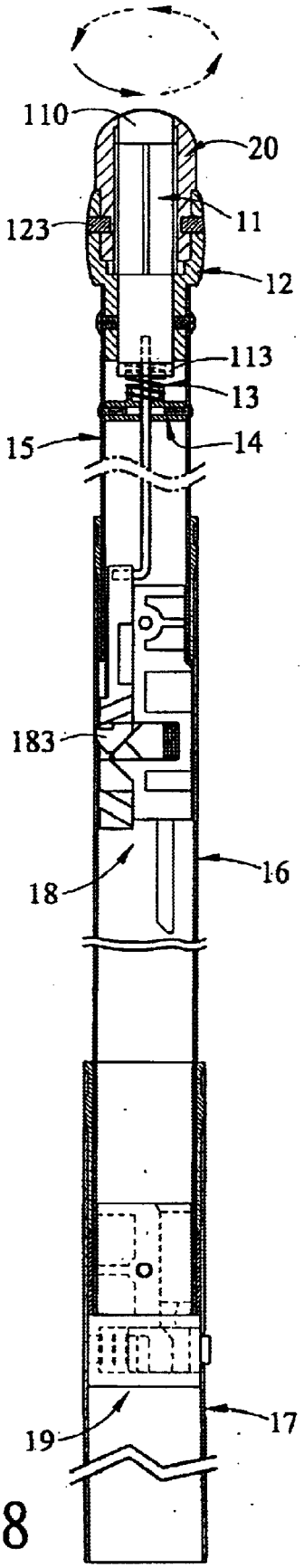
FIG. 8 is another view of FIG. 7 showing handle grip being capable of rotating.

Referring to FIGS. 7 and 8 specifically, an operation of the invention will now be described in detail as follows: First, a user can press the push button 110 to compress the spring 13. At the same time, the base 113 is lowered to disengage from the top edge of the bore 124. Also, the locking pin 183 is unlocked. Hence, user can then rotate clockwise or counterclockwise the handle grip 20 per operation until a desired angle of the handle grip 20 with respect to the luggage 50 (i.e., straight line between wheels) is reached (i.e., a position where the user feels comfortable when gripping the handle grip 20 for towing luggage). Note that the handle grip 20 is adapted to rotate 90 degrees per operation because the elements 111, 220, 124, and 113 are square (see FIGS. 4 and 5). In another embodiment, the handle grip 20 is adapted to rotate 45 degrees per operation since the elements 111, 220, 124, and 113 are made as octagons. In still another embodiment, the handle grip 20 is adapted to rotate 30 degrees per operation since the elements 111, 220, 124, and 113 are made as ones having twelve equal sides.

Figure 9:
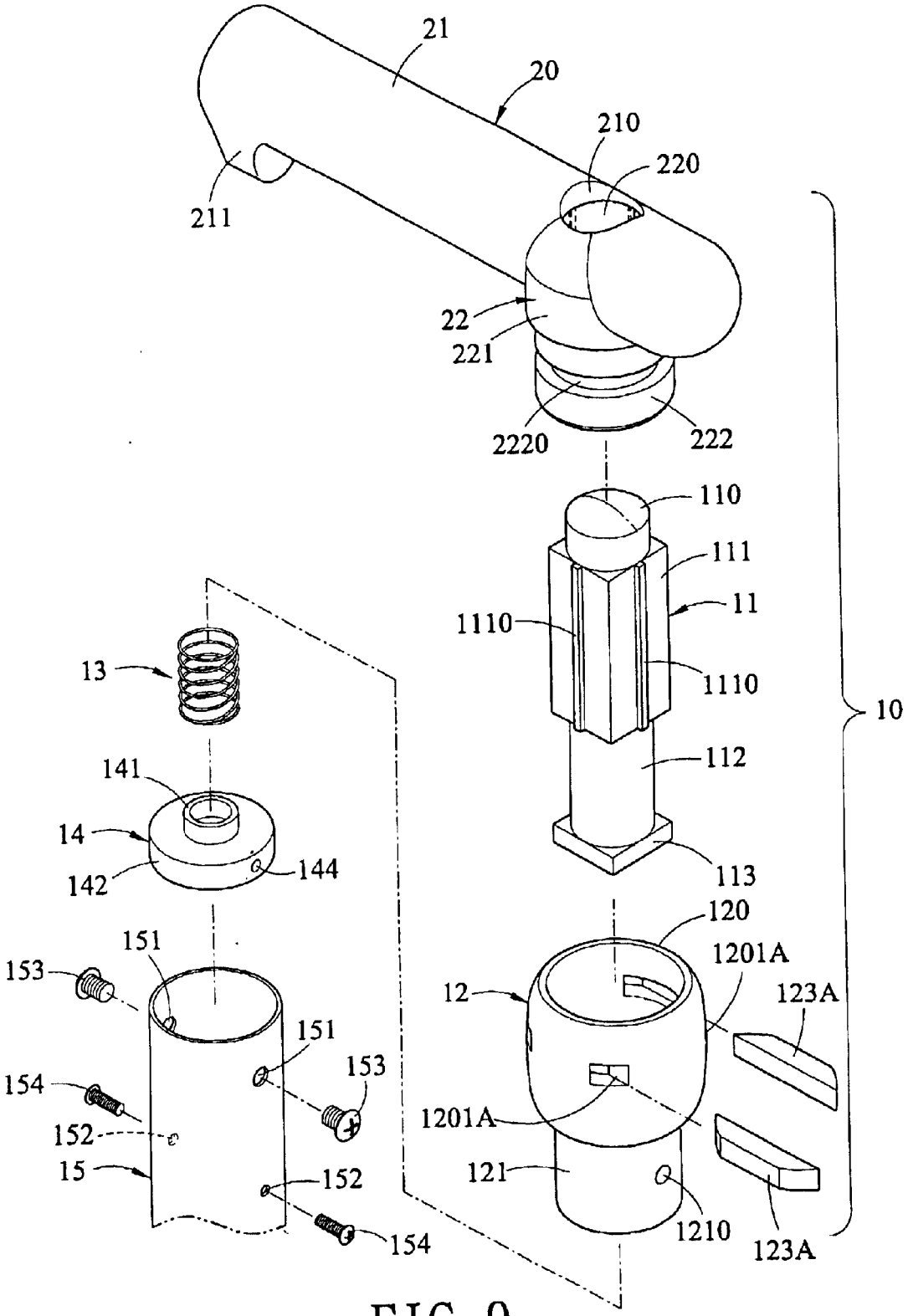
FIG. 9 is an exploded perspective view of a third preferred embodiment of handle assembly having a single handle rod according to the invention.

Referring to FIG. 9, there is shown a third preferred embodiment of handle assembly 10 according to the invention. The differences between the second and the third embodiments are that four pegs 123 of the second embodiment are replaced by two elongate members 123A each having a circular (or square) cross-section; and four equally spaced apart holes 1201 are replaced by four spaced apart holes 1201A while having shapes different from that of the holes 1201.

Figure 10:
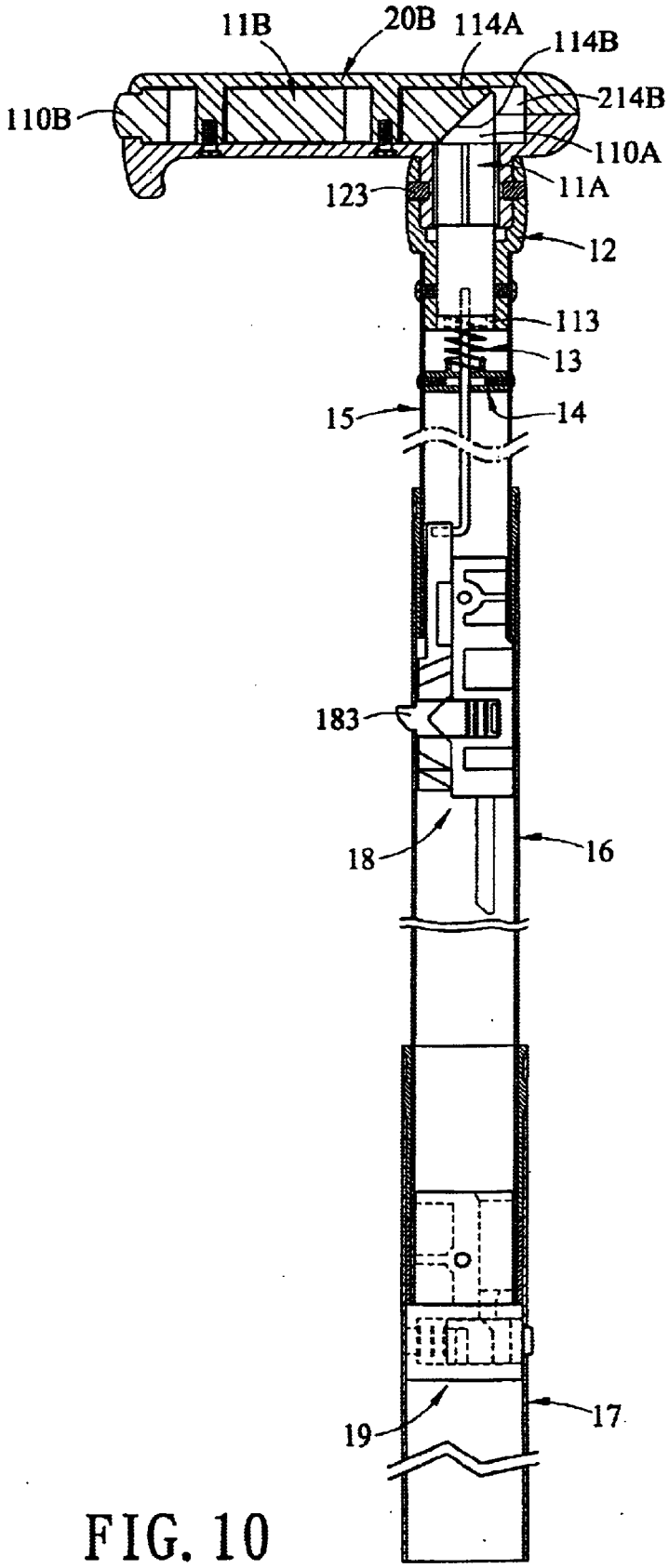
FIG. 10 is a cross-sectional view of a fourth preferred embodiment of handle assembly having a single handle rod according to the invention where handle assembly is in a locked position.
Figure 11:
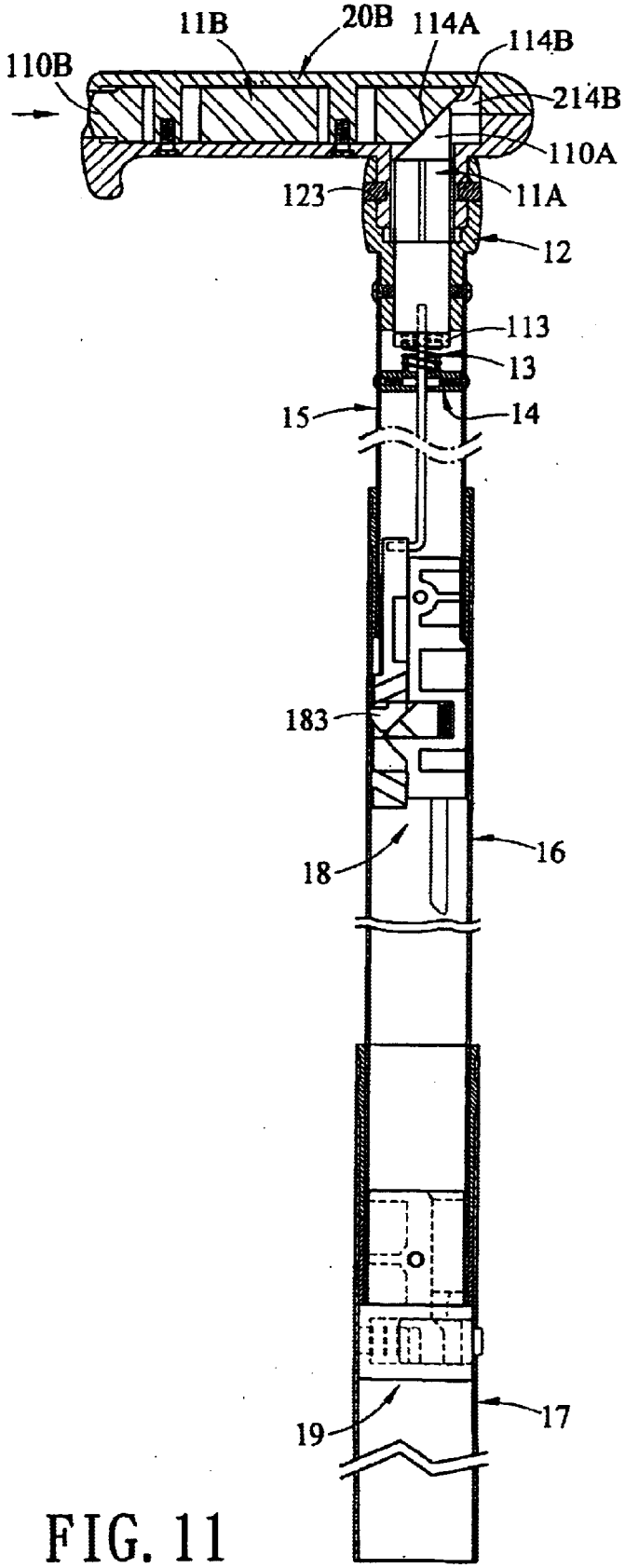
FIG. 11 is a view similar to FIG. 10 where push button is pressed and handle assembly is in an unlocked position.

Referring to FIGS. 10 and 11 there is shown a fourth preferred embodiment of handle assembly 10 according to the invention. The differences between the second and the fourth embodiments are that the handle grip 20B is hollow and having a space 214B, the push button assembly 11 is replaced by a push button assembly 11A including a wedge 110A on top of the post 111 having a slanted surface 114A, and a sliding member 11B in the space 214B and having a horizontal push button 110B at one side on the opening of the handle grip 20*b* and a slanted surface 114B at the other opposite side engaged with the slanged surface 114A.

Referring to FIG. 11 specifically, an operation of the fourth embodiment of the invention will now be described in detail as follows: First, a user can press the push button 110B to push the sliding member 11B inwardly. At the same time, the slanted surface 114B moves inwardly to press down the slanted surface 114A. As a result, the spring 13 is compressed to energize, the base 113 is lowered to disengage from the top edge of the bore 124, and the locking pin 183 is unlocked. Similarly, the user can then rotate clockwise or counterclockwise the handle grip 20B until a desired angle of the handle grip 20B with respect to the luggage 50 is reached.

Figure 12:
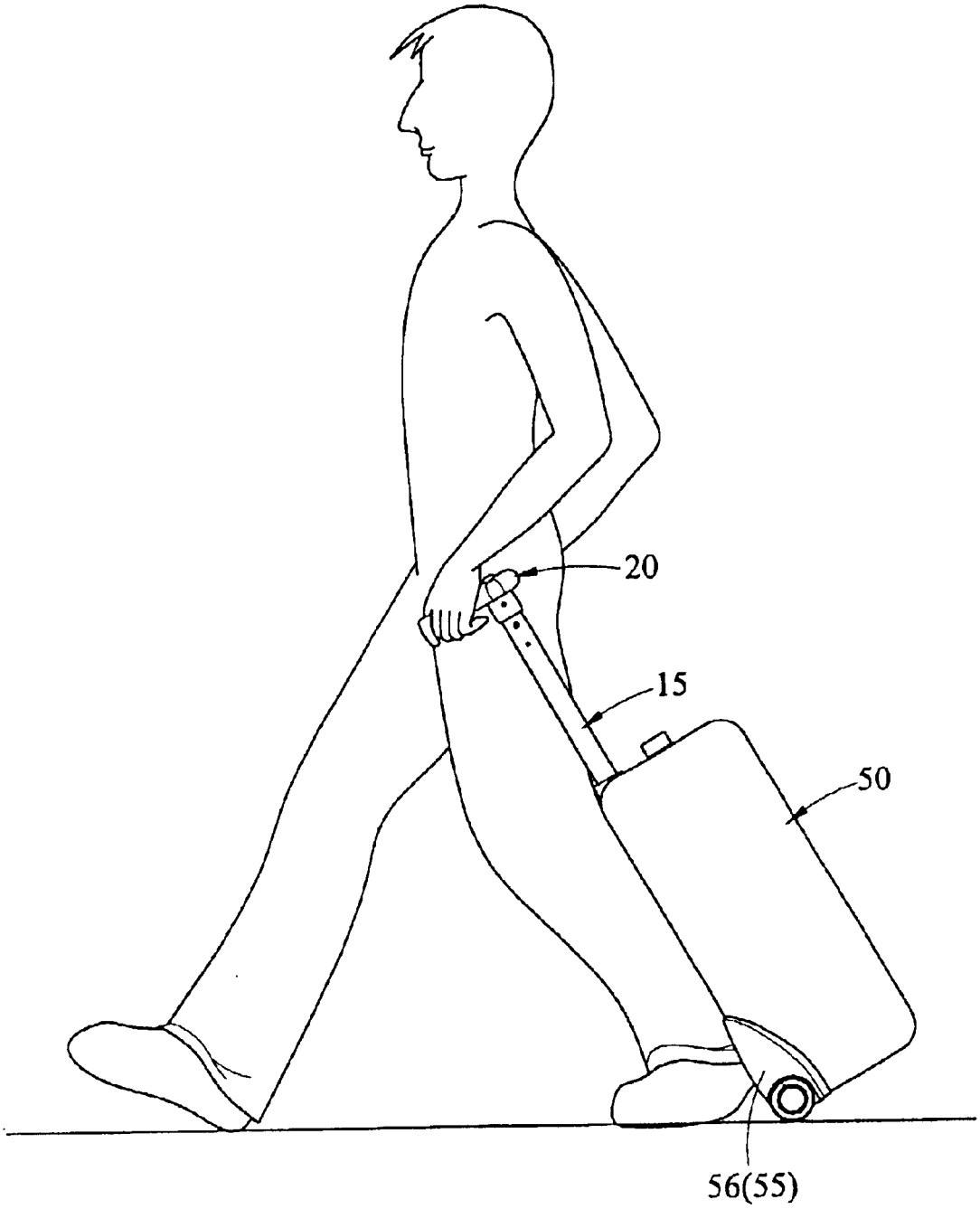
FIG. 12 is a side view showing a using of luggage handle constructed according to any of above preferred embodiments of the invention being towed.

As state above, the characteristics of the invention is that the handle grip is extended toward and sufficiently proximate one side of the luggage for being adapted to be gripped by the user's either hand, thus leaving a sufficient distance between the user's foot and either wheel for preventing a possible interference of user's foot with the wheel from occurring while towing the luggage. Additionally, the invention comprises the characteristics by referring to FIG. 12. As shown, handle grip 20 is rotated clockwise or counterclockwise to an about 90-degree angle with respect to the luggage 50, i.e., with respect to the straight line between wheels of the luggage 50. At this position, the user can also smoothly tow the luggage 50 by holding the handle grip 20. Note that above mechanism of the rotation of the handle grip 20 with respect to the luggage 50 may be eliminated in any of other embodiments in a suitable scheme (i.e., the handle grip 20 is fixed on the handle assembly 10).

Figure 14:
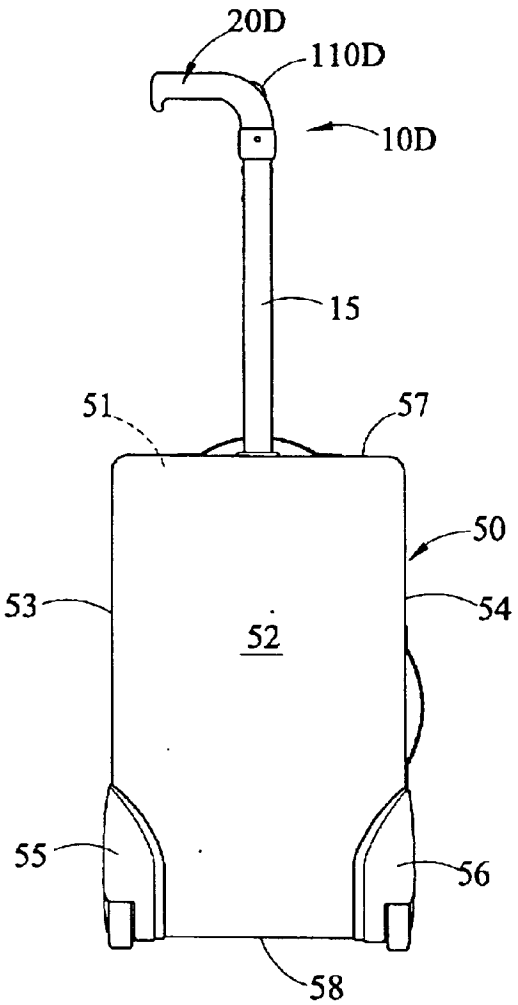
FIG. 14 is a rear plan view of a third configuration of handle grip of the handle assembly according to the invention.
Figure 13:
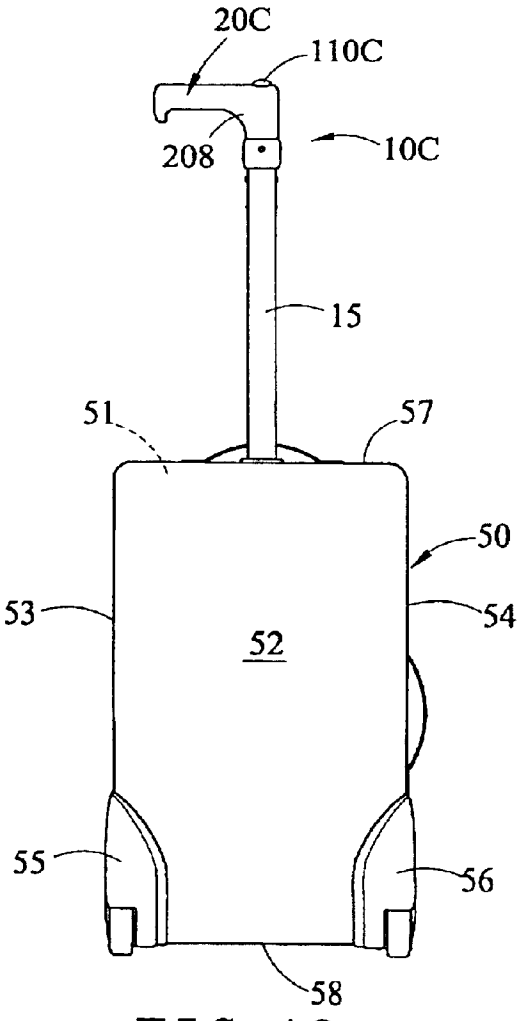
FIG. 13 is a rear plan view of a second configuration of handle grip of the handle assembly according to the invention.
Figure 15:
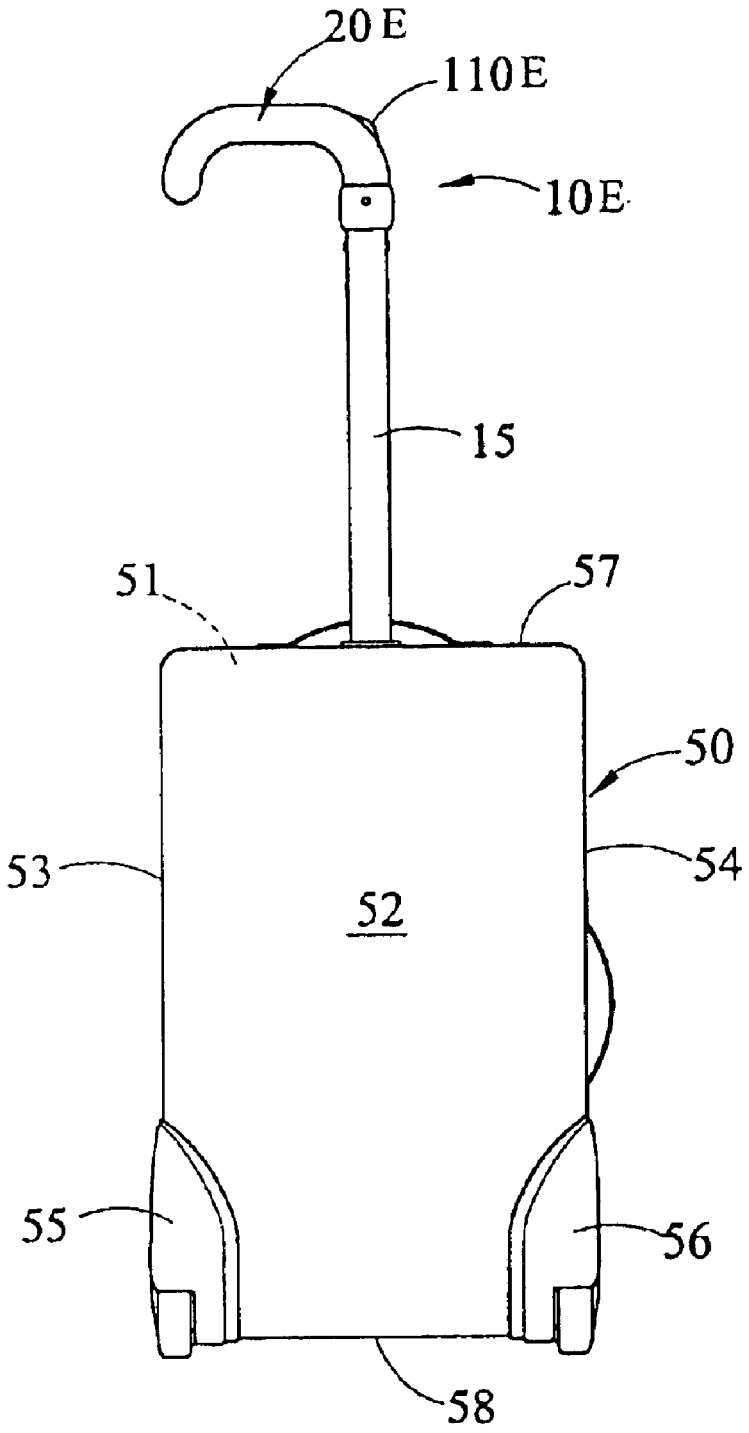
FIG. 15 is a rear plan view of a fourth configuration of handle grip of the handle assembly according to the invention.
Figure 17:
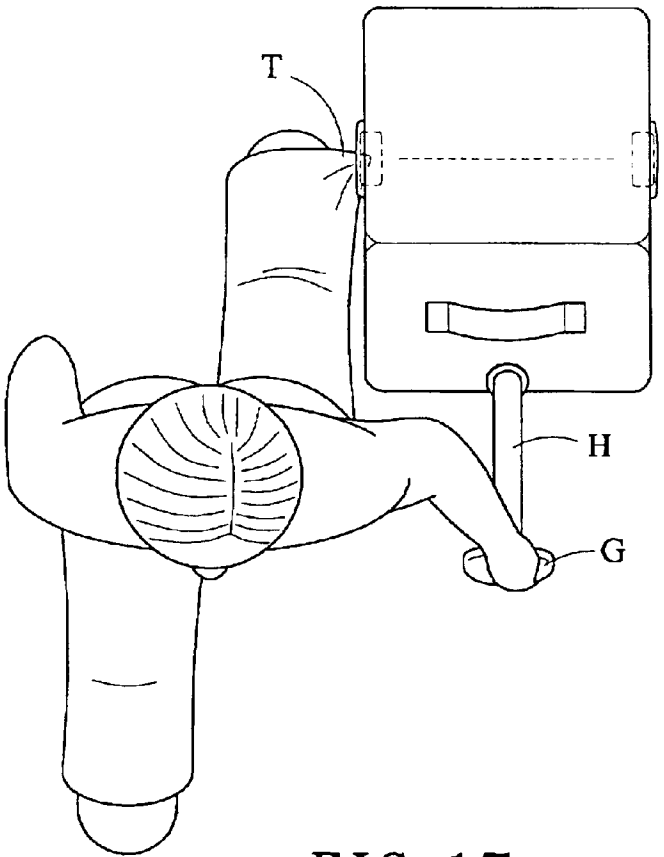
FIG. 17 (PRIOR ART)
FIG. 17 is a top plan view showing the FIG. 16 luggage being towed.
Figure 16:
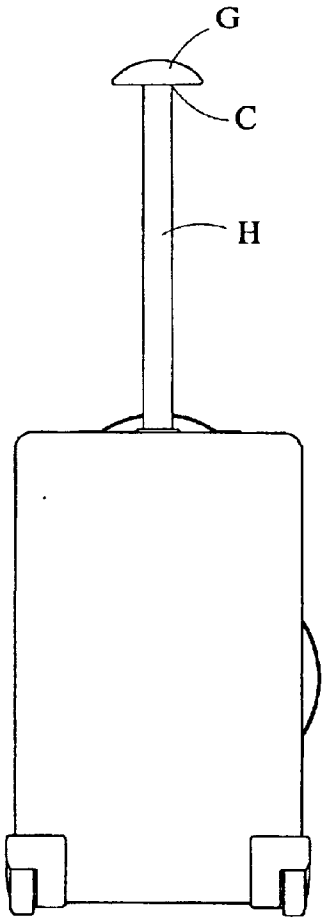
FIG. 16 (PRIOR ART)
FIG. 16 is a rear plan view of a conventional luggage handle assembly having a single handle rod.

Referring to FIGS. 13 to 15, there are shown three different configurations of the handle grip 20. As shown in FIG. 13, a handle grip 20C has an arcuate inner edge 208 of a joint between itself and the first sliding tube 15. The handle grip 20C of handle assembly 10C includes a push button 110C. As shown in FIG. 14, a handle grip 20D of handle assembly 10D has an arcuate joint between itself and the first sliding tube 15 and a push button 110D is disposed on a top of the arcuate joint. As shown in FIG. 15, a handle grip 20E has an arcuate joint between itself and the first sliding tube 15 and an arcuate hooked end having a construction similar to that of the arcuate joint. The handle grip 20E of handle assembly 10E includes a push button 110E.

While the invention herein disclosed has been described by means of specific embodiments, numerous modifications and variations could be made thereto by those skilled in the art without departing from the scope and spirit of the invention set forth in the claims.

What is claimed is:

1. The luggage having a front, a rear, two sides, a top, two wheels and a handle assembly, the handle assembly of wheeled luggage comprising:

a handle rod having an upper portion and a lower portion;

a handle grip extended horizontally from the upper portion of the handle rod and toward the side of the luggage parallel to a straight line between two wheels, for eliminating an interference of a user with one or more wheels of the luggage, the handle grip including a pivot section at the upper portion of the handle rod;

a sleeve including an upper larger section having a plurality of holes on its periphery, a plurality of pegs inserted through the holes to slidingly contact a groove of the pivot section, a lower smaller section, and a bore through the lower smaller section;

a push button assembly received in both the pivot section and the sleeve and including a push button on a top, a post extended downwardly from the push button, and a lower cylindrical member extending downwardly from the post;

a seat releasably secured within the handle rod and having a circular flange on a top; and a spring having a top end anchored in a recess of the push button and a lower end put on the flange of the seat;

wherein in an operation, the push button is operative to press to compress the spring and to lower a base of the push button for disengaging from the bore of the sleeve, thereby enabling a rotation of the handle grip and a retraction of the handle rod.

2. The handle assembly of claim 1, wherein the pivot section of the handle grip further comprises a first tunnel, a second tunnel within the first tunnel and having a longitudinal slit on an inner side surface thereof, an upper section, a lower section, and a peripheral groove between the upper and the lower sections; and the push button further comprises a longitudinal rib on an outer side surface of the post being slidingly received in the slit of the second tunnel, and the lower cylindrical member extending downwardly from the post and having a diameter smaller than a width of the post, and the base is provided at a bottom of the cylindrical member, and the recess on a bottom of the base.

3. The handle assembly of claim 2, wherein each of the post, the second tunnel, the bore, and the base has a twelve sided shape so that the handle grip is adapted to rotate clockwise or counterclockwise at an angle of 30 degrees with respect to the straight line per operation.

4. The handle assembly of claim 2, wherein each of the post, the second tunnel, the bore, and the base has a four sided shape so that the handle grip is adapted to rotate clockwise or counterclockwise at an angle of 90 degrees with respect to the straight line per operation.

5. The handle assembly of claim 2, wherein the first tunnel has an inner diameter larger than that of the second tunnel, and the upper section of the handle grip is larger than the lower section thereof.

6. The handle assembly of claim 1, wherein the rotation of the handle grip is carried out either clockwise or counterclockwise to an angle of about 180 degrees with respect to a straight line between wheels of the luggage.

7. The handle assembly of claim 1, wherein the handle grip comprises a downwardly extended hook at one end proximate the side of the luggage.

8. The handle assembly of claim 1, wherein the handle rod is disposed between one end of the handle grip and the other end thereof and proximate the other end.

9. The luggage having a front, a rear, two sides, a top, two wheels and a handle assembly, the handle assembly of wheeled luggage comprising:

a handle rod having an upper portion and a lower portion, the handle rod extended upward from a center at a joining edge of the top and the rear of the luggage;

a handle grip extended horizontally from the upper portion of the handle rod and toward the side of the luggage parallel to a straight line between two wheels, for eliminating an interference of a user with one or more wheels of the luggage, the handle grip including a hollow bar having a space, and a pivot section at the upper portion of the handle rod;

a sleeve including an upper larger section having a plurality of holes on its periphery, a plurality of pegs inserted through the holes to slidingly contact a peripheral groove of the pivot section, a lower smaller section, and a bore through the lower smaller section;

a push button assembly received within the space of the hollow bar, the pivot section and the sleeve and including a wedge having a first slanted surface on a top of a post, and a sliding member received within the space of the handle grip and having a horizontal push button at one side on an opening of the hollow bar, a second slanted surface at the other opposite side engaged with the first slanted surface, the post extended downwardly from the wedge, and a lower cylindrical member extending downwardly from the post;

a seat releasably secured within the handle rod and including a circular flange on a top; and a spring having a top end anchored in the cylindrical member and a lower end put on the circular flange of the seat;

wherein in an operation, the push button is operative to press to push the sliding member inwardly, move the second slanted surface inwardly to press down the first slanged surface, compress the spring, and to lower the cylindrical member for disengaging from the bore of the sleeve, thereby enabling a rotation of the handle grip and a retraction of the handle rod.

10. The handle assembly of claim 9, wherein the pivot section of the handle grip further comprises a first tunnel having a longitudinal slit on an inner side surface thereof, an upper section, a lower section, and the peripheral groove is located between the upper and the lower sections; and the push button assembly further comprises a longitudinal rib on an outer side surface of the post being slidingly received in the slit of the tunnel of the pivot section, the lower cylindrical member extending downwardly from the post and having a diameter smaller than a width of the post, and a base provided at a bottom of the cylindrical member, and a recess on a bottom of the base.

11. The handle assembly of claim 10, wherein each of the post, the tunnel, the bore, and the base has a twelve sided shape so that the handle grip is adapted to rotate clockwise or counterclockwise at an angle of 30 degrees with respect to the straight line per operation.

12. The handle assembly of claim 9, the rotation of the handle grip is carried out either clockwise or counterclockwise to an angle of about 180 degrees with respect to a straight line between wheels of the luggage.

13. The handle assembly of claim 9, wherein the handle grip comprises a downwardly extended hook at one end proximate the side of the luggage.

14. The handle assembly of claim 9, wherein the handle rod is disposed between one end of the handle grip and the other end thereof and proximate the other end.

15. The handle assembly of claim 9, wherein the handle grip has an arcuate joint between itself and the handle rod and an arcuate hooked end opposite to the arcuate joint.

* * * * *